US008344893B1

(12) United States Patent
Drammeh

(10) Patent No.: US 8,344,893 B1
(45) Date of Patent: Jan. 1, 2013

(54) HYGIENIC ASSURANCE SYSTEM FOR MONITORING THE HAND WASHING OF AN INDIVIDUAL

(76) Inventor: Sheikh Moussa Drammeh, Bronx, NY (US)

( * ) Notice: Subject to any disclaimer, the term of this patent is extended or adjusted under 35 U.S.C. 154(b) by 338 days.

(21) Appl. No.: 12/815,771

(22) Filed: Jun. 15, 2010

(51) Int. Cl.
*G08B 23/00* (2006.01)

(52) U.S. Cl. ..... 340/573.1; 340/540

(58) Field of Classification Search ..... 340/573.1, 340/542, 540
See application file for complete search history.

(56) References Cited

U.S. PATENT DOCUMENTS

| | | | |
|---|---|---|---|
| 3,938,120 | A | 2/1976 | O'Connell |
| 4,606,085 | A | 8/1986 | Davies |
| 5,610,589 | A | 3/1997 | Evans et al. |
| 5,952,924 | A | 9/1999 | Evans et al. |
| 6,236,317 | B1 | 5/2001 | Cohen et al. |
| 6,523,193 | B2 | 2/2003 | Saraya |
| 6,727,818 | B1 | 4/2004 | Wildman et al. |
| 6,975,231 | B2 | 12/2005 | Lane et al. |
| 2009/0051545 | A1 * | 2/2009 | Koblasz ..... 340/573.1 |

FOREIGN PATENT DOCUMENTS

| | | |
|---|---|---|
| EP | 0921506 | 6/1999 |
| GB | 2425388 | 10/2006 |
| WO | WO01/33529 | 5/2001 |
| WO | WO03/082351 | 10/2003 |

* cited by examiner

*Primary Examiner* — Shirley Lu
(74) *Attorney, Agent, or Firm* — Michael I. Kroll

(57) ABSTRACT

A hygiene assurance system utilizing a plurality of individual sensors having a correlating fixture or entrance, a camera for identifying the user and a plurality of visual and audible signals to ensure a user of a bathroom facility washes ones hands for at least 16 seconds to complete a satisfactory hand washing operation before leaving the area. Additionally the present invention provides sensors having individual controls for what predetermined parameters must be met to activate said sensor.

7 Claims, 8 Drawing Sheets

HYGIENIC ASSURANCE SYSTEM FOR MONITORING THE HAND WASHING OF AN INDIVIDUAL

BACKGROUND OF THE INVENTION

1. Field of the Invention

The present invention relates generally to a hygienic assurance system and, more specifically, to a room providing a standard bathroom facility having the addition of a plurality of sensors to control and initiate a plurality of visual and audible signals used to ensure and remind users to wash their hands along with recording and indicating means to enforce and identify users in violation of a required hygienic practice post operative of using said facilities.

Comprising the present invention are a plurality of sensors mounted to an entrance that is also monitored by a camera that relays to a second set of sensors that detect the usage of a toilet or urinal that then require a third set of sensors to be satisfied in the appropriate usage of a wand washing fixture to complete a required bathroom usage regiment.

If the user does not satisfy the predetermined hygiene requirements a plurality of visual and audible indicators are flashed or sounded to remind the user to meet hygiene requirements until they are met, in the case where the user ignores the presented protocol a recording means such as a camera or video recorder may be utilized along with sensor records to identify said user and provide evidence of disregard for hygiene procedure for later reprimanding of the user by the facilities owner or hygiene enforcer.

2. Description of the Prior Art

There are other hygiene systems designed for ensuring the washing of hands. Typical of these is U.S. Pat. No. 3,938,120 issued to O'Connell on Feb. 10, 1976.

Another patent was issued to Davies on Aug. 19, 1986 as U.S. Pat. No. 4,606,085. Yet another U.S. Pat. No. 5,610,589 was issued to Evans et al. on Mar. 11, 1997 and still yet another was issued on Sep. 14, 1999 to Evens et al. as U.S. Pat. No. 5,952,924.

Another patent was issued to Cohen et al. on May 22, 2001 as U.S. Pat. No. 6,236,317. Yet another U.S. Pat. No. 6,523,193 was issued to Saraya on Feb. 25, 2003. Another was issued to Wildman et al. on Apr. 27, 2004 as U.S. Pat. No. 6,727,818 and still yet another was issued on Dec. 13, 2005 to as U.S. Pat. No. 6,975,231.

Another patent was issued to Jacques on Jun. 9, 1999 as European Patent No. EP0921506. Yet another PCT Patent No. WO0133529 was issued to Wildman on Oct. 30, 2000. Another was issued to Path-X international Inc. on Oct. 9, 2003 as PCT Patent No. WO03082351 and still yet another was issued on Jul. 22, 2005 to Rentikil International as Brittish. Patent No. GB2425388.

U.S. Pat. No. 3,938,120

Inventor: Gerard O'Connell

Issued: Feb. 10, 1976

A talking door sentinel has a housing which is secured to the edge of a door by means of a bracket. The movement of the door away from the door frame upon its being opened, moves a trigger which actuates a battery-operated voice box inside the housing. The voice box then plays one of a number of pre-recorded messages. When the door is subsequently closed, the approaching door frame resets the trigger so that the sentinel will emit another message when the door is next opened.

U.S. Pat. No. 4,606,085

Inventor: Joseph R. Davies

Issued: Aug. 19, 1986

This invention relates to an electro mechanical-electronic device designed to prevent nosocomical contagions spread by the hands of health care personnel and others due to improper and incomplete hand washing. The device establishes a time reference for the personnel to insure the proper time standards of washing and rinsing hands are attained. Further, the automatic dispensing of a proper quantity of non-contaminated skin degermer and the replacement of natural emolients removed during the washing process is accomplished.

U.S. Pat. No. 5,610,589

Inventor: Bennie R. Evans

Issued: Mar. 11, 1997

A system of hygienic control employing a name tag to be attached to each worker in a hygienically controlled area. Each name tag has a clear signaling light source thereon indicating the worker is sanitary, and an unsanitary signaling light source thereon indicating the worker has not practiced the proper sanitation procedures. The unsanitary light source is enabled when the worker enters a sanitation area, such as a rest room, and is disabled when the worker has washed his/her hands with soap and water. Also, the clear signaling light source is enabled when the worker has complied with the proper sanitation procedure.

U.S. Pat. No. 5,952,924

Inventor: Bennie R. Evans

Issued: Sep. 14, 1999

The present invention is a system for encouraging workers who work in a hygienically controlled area to wash their hands before exiting an associated sanitation area. Broadly, the present invention comprises a housing located in the sanitation area for receiving at least a portion of the hands of the worker. A detector is operatively associated with the housing. The detector detects whether or not the hands of the worker have recently been washed in response to the insertion of the hands of the worker into the housing. A communication media is also operatively associated with the detector for outputting one of a sanitary signaling media in response to the detection that the hands of the worker have been washed and an unsanitary signaling media in response to the detection that the hands of the worker have not been washed.

U.S. Pat. No. 6,236,317

Inventor: Glenn Cohen

Issued: May 22, 2001

An apparatus and a concomitant method for promoting hygienic practices is disclosed. The apparatus is a monitoring unit for monitoring the completion of a desired action, e.g., handwashing, by a user. Upon completion of the desired action, the monitoring unit transmits a satisfactory signal to the user.

U.S. Pat. No. 6,523,193

Inventor: Ichiro Saraya

Issued: Feb. 25, 2003

The present invention provides a system and method of effectively preventing infection, and provides a fluid supply apparatus capable of being preferably used for the system. A fluid supply apparatus is disposed near a doorway of a hall of an ordinary household. The fluid supply apparatus includes a water supply function performed by a water supply nozzle, a gargle discharge function performed by a gargle nozzle, a disinfectant discharge function performed by a disinfectant nozzle, and a sink. A body detection sensor for detecting a human body that enters a room is provided above the doorway. When the body detection sensor detects a body, a voice output apparatus outputs a voice prompting the person to gargle and wash hands.

U.S. Pat. No. 6,727,818

Inventor: Timothy D. Wildman

Issued: Apr. 27, 2004

A method of monitoring hygiene compliance is provided. The method comprises the steps of receiving first location information which tracks movement and handwashing information, determining whether a person who has entered a patient contact zone has washed her hands since her most recent exposure to a contamination zone, and updating compliance information for the person based upon the determining step.

U.S. Pat. No. 6,975,231

Inventor: Stephen Lane

Issued: Dec. 13, 2005

A method and apparatus that systematically prompts staff, patients and visitors at care facilities to perform handwashing at critical time periods, for example after touching a toilet flush handle or upon entering or leaving a patient's room. A plurality of detectors are used to sense whether a person has entered an area and to determine whether the person has cleansed their hands within a predetermined period of time before entering the area or leaving the area. If it is determined that the person has cleansed their hands within the predetermined period of time, no prompting message is generated. If it is determined that the person has not cleansed their hands within the predetermined period of time, an audio/visual warning message is generated.

European Patent Number EP0921506

Inventor: Robaey Jacques

Issued: Jun. 9, 1999

The automatic system encourages correct hand washing procedures, linking the operation of the tap and door lock. The system provides control of access to a toilet cabin which includes a hand washing basin (3). The hand basin includes a tap (4) and a sensor which detects whether the tap is turned on or not. There may also be a sensor using an electromagnetic signal to detect the presence of the hands under the jet of water. These sensors are used to control a device (100) associated with the door lock (10), such that the door is automatically locked when the hand basin is in use. The locking of the door may be effective for a certain minimum duration once use of the hand basin is detected. A manual over-ride control may also be provided.

International Patent Application Number WO0133529

Inventor: Timothy Wildman

Issued: May 10, 2001

A hygiene monitoring system (100), which incorporates various features of the present invention, monitor location of persons (110) in a facility, location of equipment (115) in the facility, activities performed by persons (110) in the facility, activities performed by equipment (115) in the facility, and/or activities performed on equipment (115) in the facility. From such gathered information, the hygiene monitoring system (100) determines whether certain actions (e.g. washing of a person's hands (107), washing of a piece of equipment (115) need to take place in order to comply with a hygiene policy defined for the facility. The hygiene monitoring system (100) may evaluate level of compliance with the hygiene policy, and provide persons (110) with information (e.g. alerts, reminders, etc.) which aid in increasing the level of compliance with the hygiene policy.

International Patent Application Number WO03082351

Inventor: Path-X International

Issued: Oct. 9, 2003

A method for monitoring compliance with recommended hand-washing practices is disclosed. The method involves detecting the occurrence of an event that is specified in a hand-washing rule. The method also involves determining whether a person who is involved in the event complies with the hand-washing rule. If the person does not comply with the hand-washing rule, the method may involve triggering a reminder alarm. The method may also involve determining whether the person washes his or her hands within a period of time subsequent to the reminder alarm. Compliance data that is related to compliance with the hand-washing rule may be updated.

British Patent Number GB2425388

Inventor: Rentokil Initial

Issued: Apr. 22, 2005

A washroom has means to detect the presence of a user by way of entry and exit sensors 3 and 2 and to monitor the use of hand washing apparatus. A soap dispenser 6 includes a sensor 11 and a transmitter to signal that the dispenser has been used, indicating that hands have been washed in a basin 5. An alarm is operated if the user exits without having used the dispenser. Individual users are identified though an identification unit 18 communicating with an identity tag.

While these hygienic assurance systems may be suitable for the purposes for which they were designed, they would not be as suitable for the purposes of the present invention, as hereinafter described.

SUMMARY OF THE PRESENT INVENTION

A primary object of the present invention is to provide a hygiene assurance system whereby the user may be identified monitored and reminded to wash their hands after using a bathroom facility.

Another object of the present invention is to provide a hygiene assurance system utilizing a plurality of sensors to detect the usage of individual bathroom fixtures.

Yet another object of the present invention is to provide a hygiene assurance system wherein said plurality of sensors have individual controls for what predetermined parameters must be met to activate said sensor.

Still yet another object of the present invention is to provide a hygiene assurance system wherein said plurality of sensors are in electrical communication with a microprocessor.

An additional object of the present invention is to provide a hygiene assurance system having sensors mounted to the entrance of a bathroom facility to detect and record the ingress and egress of a user through said entrance.

A further object of the present invention is to provide a hygiene assurance system wherein said sensors includes a toilet and/or urinal sensor(s) to detect use of said toilet and/or urinal.

A yet further object of the present invention is to provide a hygiene assurance system wherein said sensors includes a sink water sensor to detect use of said sink.

A still yet further object of the present invention is to provide a hygiene assurance system having a plurality of audible and visual reminders to a user to wash their hands.

Another object of the present invention is to provide a hygiene assurance system wherein said plurality of audible and visual reminders are actuated by said microprocessor.

Yet another object of the present invention is to provide a hygiene assurance system having a camera providing pictures or video recordings of the user of a bathroom facility.

Still yet another object of the present invention is to provide a hygiene assurance system where the user is required to wash ones hands at least 16 seconds to complete an adequate washing procedure.

Additional objects of the present invention will appear as the description proceeds.

The present invention overcomes the shortcomings of the prior art by providing a hygiene assurance system utilizing a plurality of individual sensors in electrical communication with a microprocessor having a correlating fixture or entrance sensor, a camera for identifying the user and a plurality of visual and audible signals to ensure a that a user of a bathroom facility washes their hands for at least 16 seconds to complete a satisfactory hand washing operation before leaving the area. Additionally the present invention provides sensors having individual controls for what predetermined parameters must be met to activate said sensor.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
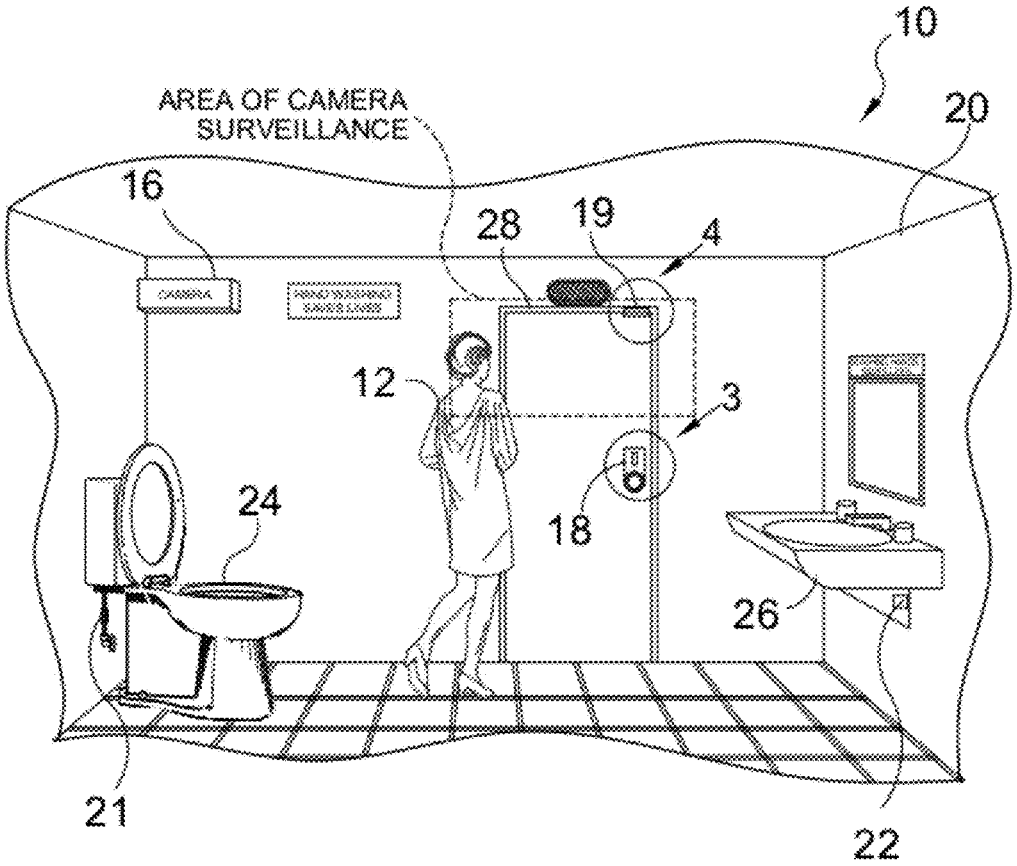
FIG. 1 is an illustrative view of the present invention in use.

Turning now descriptively to the drawings, in which similar reference characters denote similar elements throughout the several views, the figures illustrate the Hygiene Assurance System of the present invention. With regard to the reference numerals used, the following numbering is used throughout the various drawing figures.

| | |
|---|---|
| 10 | Hygiene Assurance System of the present invention |
| 12 | user |
| 14 | user's hands |
| 16 | camera |
| 18 | doorknob sensor |
| 19 | door frame sensor connector |
| 20 | restroom |
| 21 | commode water usage sensor |
| 22 | sink water usage sensor |
| 24 | commode |
| 26 | sink |
| 28 | door of 20 |
| 30 | audio speaker |
| 32 | visual indicator |
| 34 | doorknob |
| 36 | connection terminal of 19 |
| 38 | contact |
| 40 | door frame |
| 42 | drain line |
| 44 | control panel of 22 |
| 46 | user controls of 44 |
| 48 | digital display of 44 |
| 50 | coupling of 22 |
| 52 | remote connection to microprocessor |
| 54 | microprocessor |
| 56 | memory |
| 58 | printer |
| 60 | data transmission cable |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. Shown is the present invention 10, a systematic method of ensuring and monitoring the washing of a user's 12 hands after their usage of a rest room facility 20. The present invention 10 comprises a camera 16, a plurality of door 28 sensors 18, 19, water usage sensors 21, 22 affiliated with the various fixtures such as a commode 24 and sink 26 to monitor the usage thereof by the user 12 upon entering and exiting the room that their hands must be washed before leaving the room 20. An audio speaker 30 and visual indicators 32 are also provided to remind the user 12 to wash their hands and assure they were adequately washed.

Figure 2:
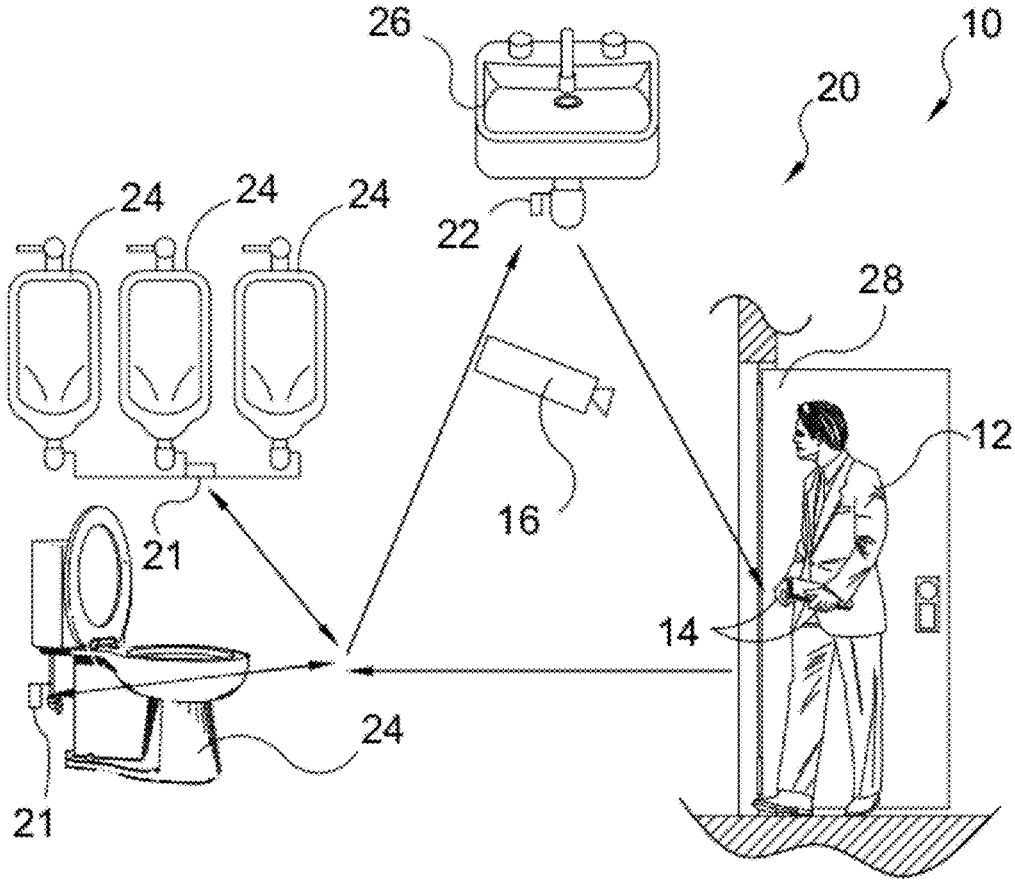
FIG. 2 is an illustrative view of the present invention in use.

FIG. 2 is an illustrative view of the present invention 10 in use. Shown is the present invention 10 activated upon the user 12 entering through the door 28 the restroom 14. The camera 16 identifies the user 12 upon entry through the door 28. The commode water usage sensors 21 detect when a commode 24 (which hereinafter refers to all toilets, urinals and the like) has been flushed and a processor is informed that the sink 26 should be used immediately thereafter. The sink water usage sensors 22 then determine whether the sink 26 has been used and if the duration was adequate for cleaning the hands 14 of the user 12.

Figure 3:
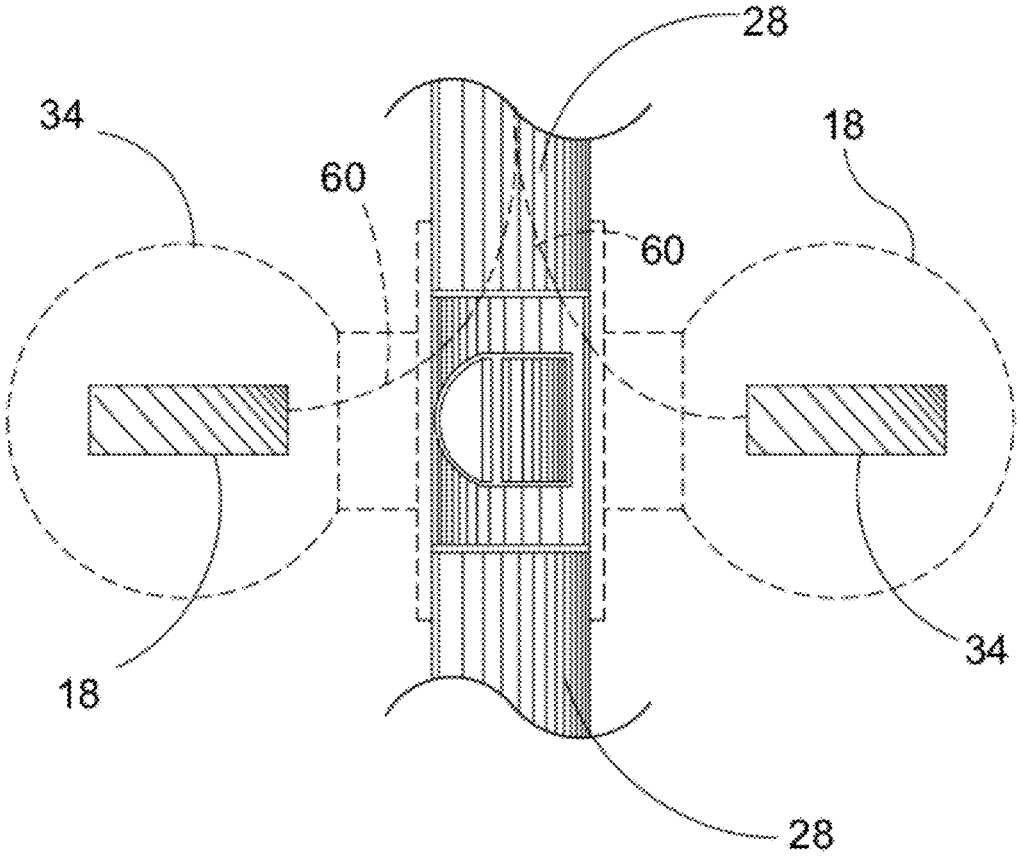
FIG. 3 is an illustrative view of the present invention.

FIG. 3 is an illustrative view of the doorknob sensor 18 of the present invention. Shown are the door knob sensors 18 of the present invention that function individually to sense touch of its respective doorknobs 34 to indicate either the ingress or egress of an individual though the door 28 into the facility thereby transmitting that data through a data transmission cable 60 and executing predetermined functions such as a specific audio message or visual indicator as a reminder to the user when entering and leaving the rest room facility.

Figure 4:
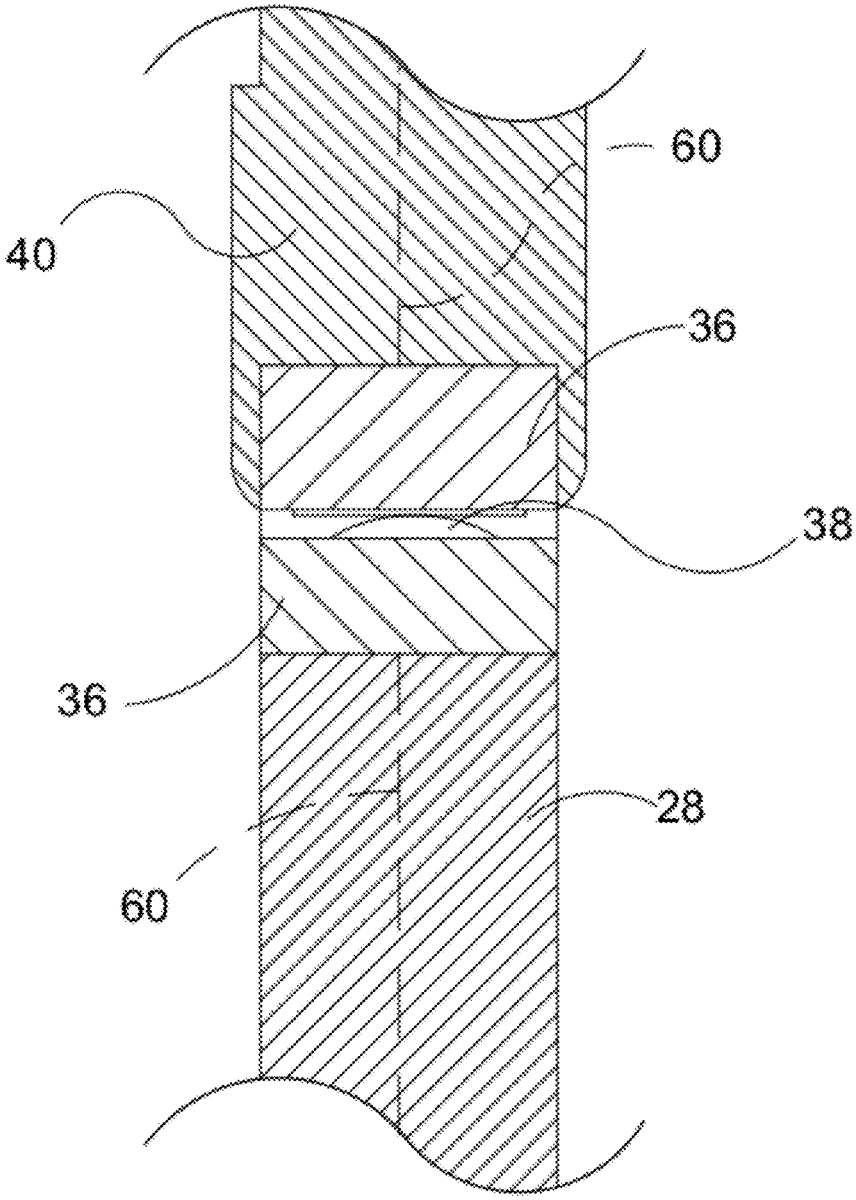
FIG. 4 is a sectional view of the present invention.

FIG. 4 is a sectional view of the doorframe sensor 19. Shown are the connection terminals 36 of the present invention that serve to indicate the opening and closing of the door 28 along with acting as a transmission line to maintain the integrity of the data transmission cable 60 between the door 28 and door handle sensors to the door frame 40 of the outside wall where the signal can then be directed to a cpu.

Figure 5:
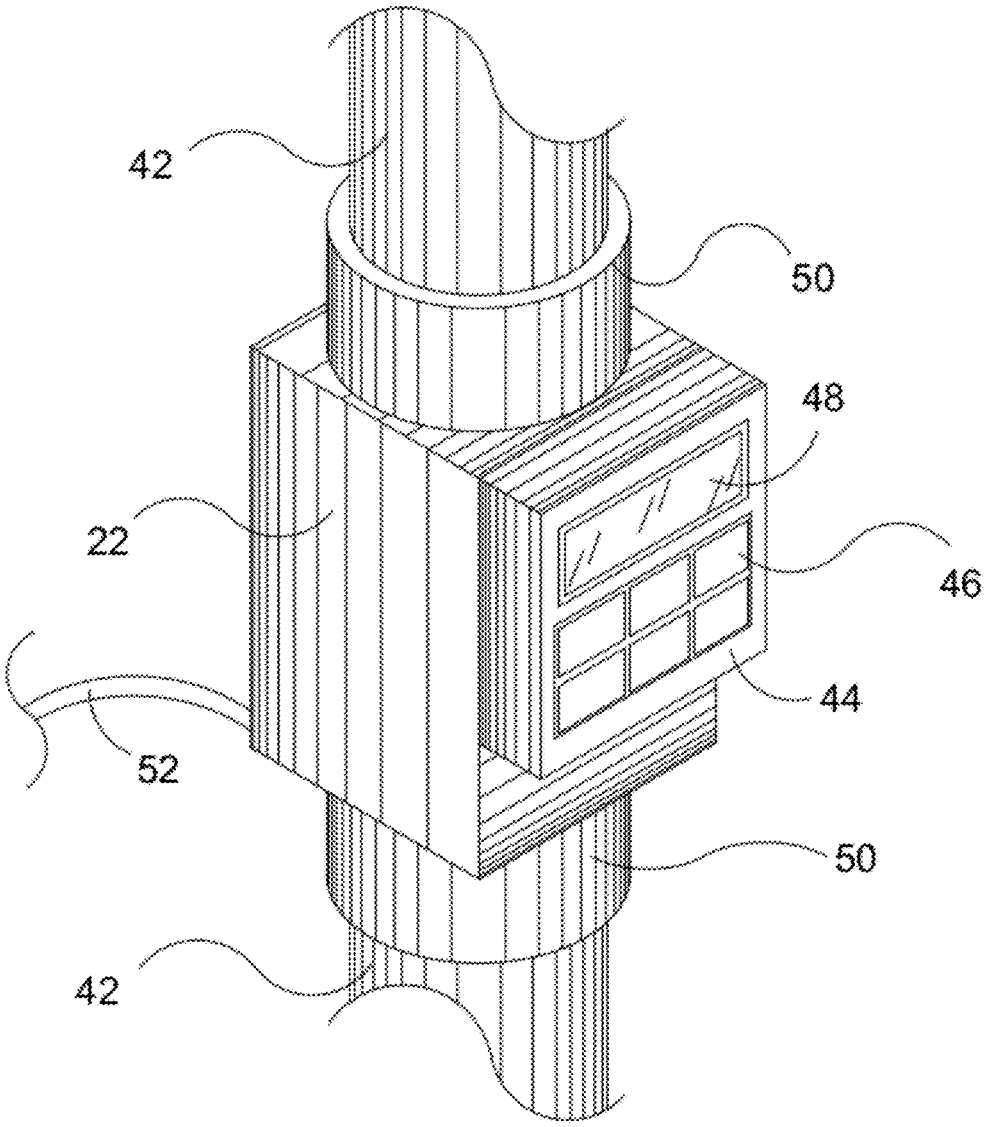
FIG. 5 is a sectional view of the present invention.

FIG. 5 is a sectional view of the sink water usage sensor 22 of the present invention that functions as a monitor for water usage outfitted to the sink's 26 drainage line 42 to monitor for an amount of water sufficient to wash one's hands as determined by an integral control panel 44 with user controls 46 and digital display 48. The water used can be specifically monitored and sent to a memory source via a remote connection 52. Couplings 50 are provided on the top and bottom of the sink water usage sensor 22 for ease in installation.

Figure 6:
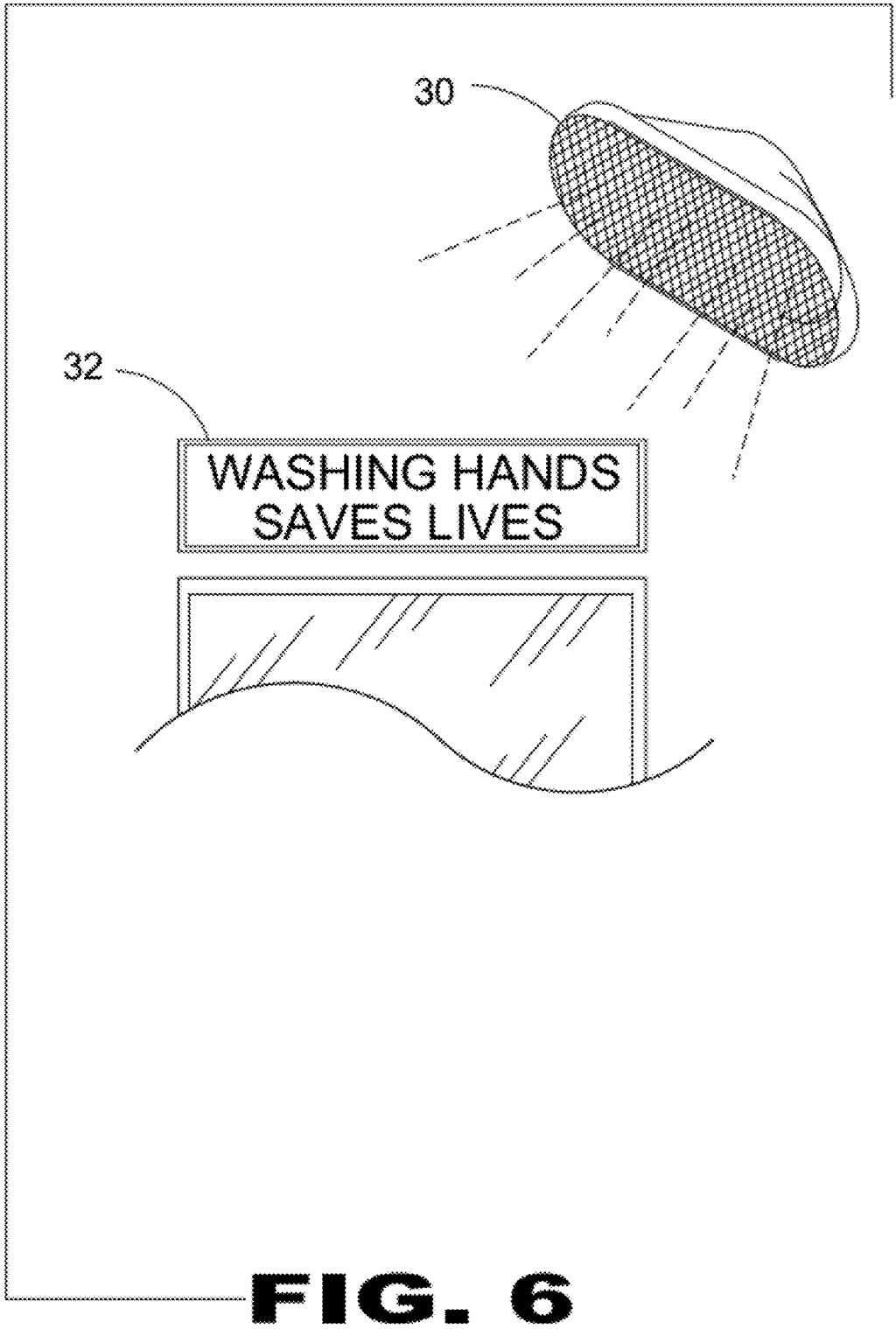
FIG. 6 is an illustrative view of the present invention in use.

FIG. 6 is an illustrative view of the visual indicator 32 and audio speaker 30. Shown are the two primary communication devices of the present invention comprising a lighted display 32 for visual messaging and a speaker 30 for emitting verbal instructions or an alarm.

Figure 7:
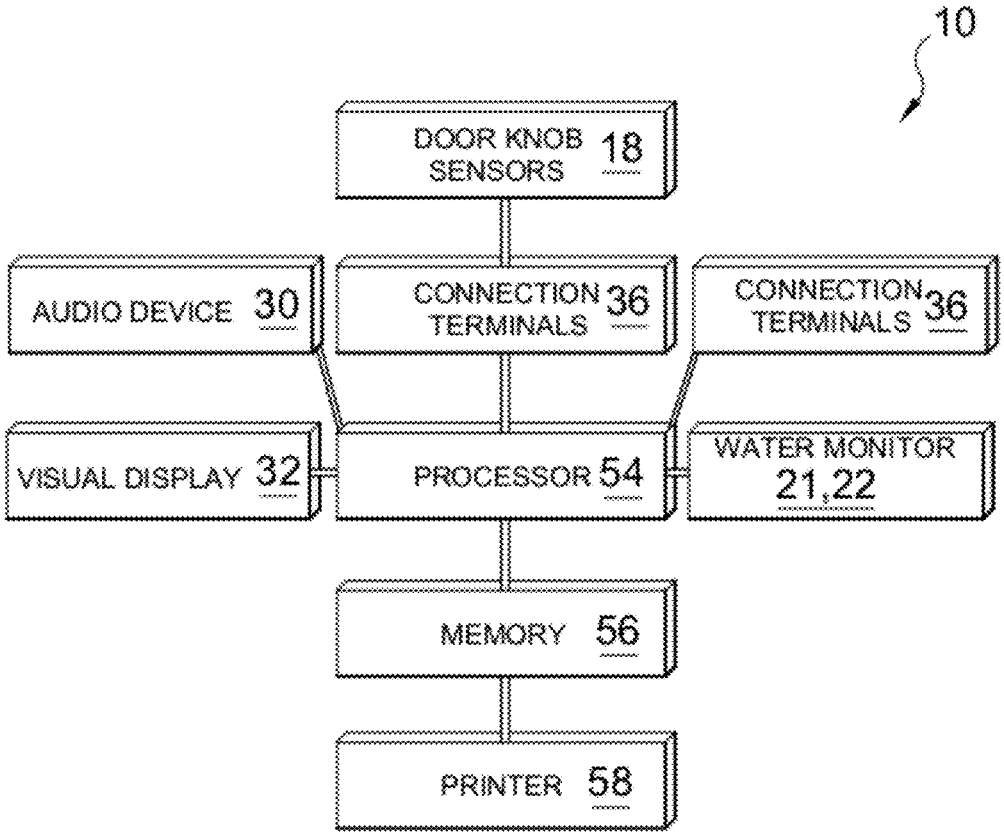
FIG. 7 is a chart depicting the components of the present invention.

FIG. 7 is a chart depicting the components of the present invention 10. The doorknob sensors 18 are in send a signal through the connection terminals 36 to the processor 54. The water sensors 21, 22 transmit data to the processor 54 to determine if the water ran for at least 16 seconds to count as a hand wash. Appropriate audible 30 and visual 32 messages are initiated. A memory 56 and printer 58 are provided to store data and photos for later review and transfer to hard copy.

Figure 8:
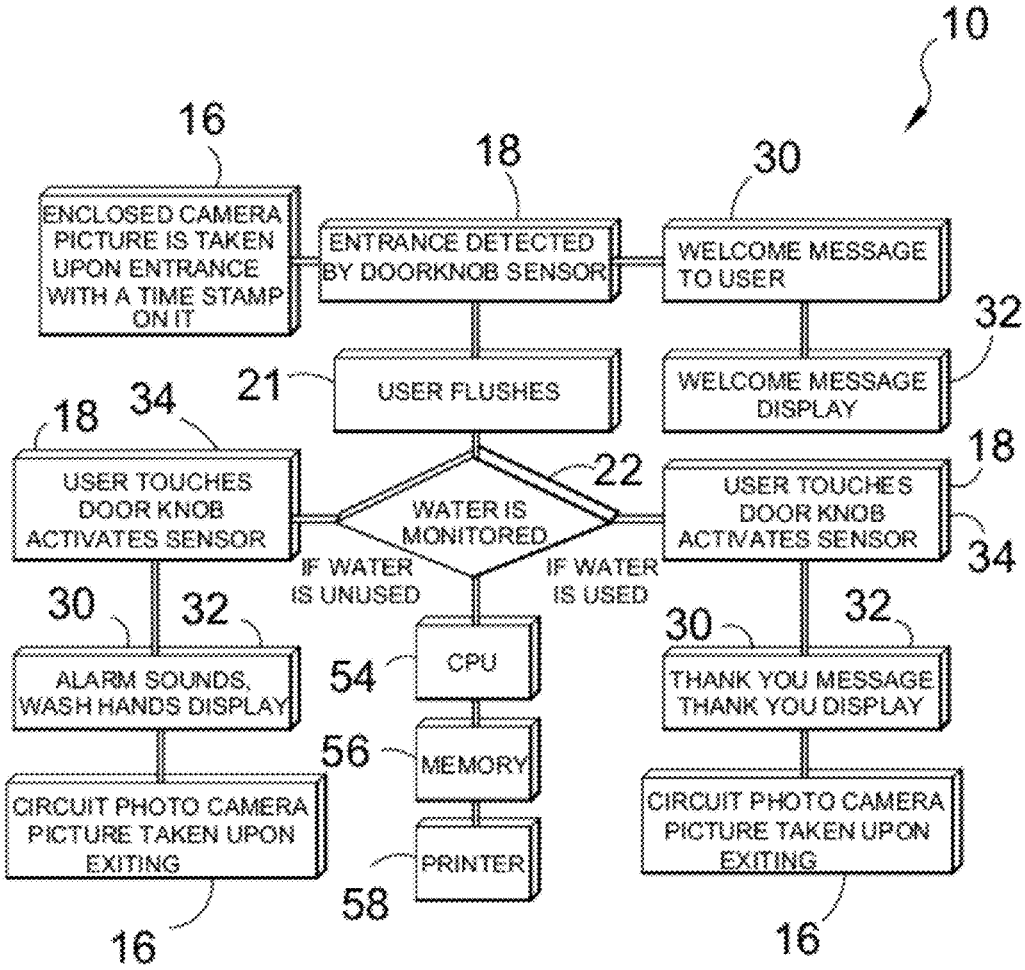
FIG. 8 is a chart depicting the system of the present invention.

FIG. 8 is a chart depicting the system of the present invention 10. Shown is a chart showing the course of events taken through the present invention 10 by its components and human interaction whereby an entering user 12 is greeted then monitored by a camera 16 and upon leaving the user turns the doorknob 34 and the doorknob sensor 18 activates a visual display 32 and audible alarm 30 with an inadequate washing alert or thank you farewell message depending on the result of the sink water usage sensor 22. The user flushes the toilet and a commode water user sensor 21 informs a processor 54 that the sink should be used and the sink water usage sensor 22 assures that the sink is operated for at least sixteen seconds for an adequate hand washing. A memory 56 and printer 58 are provided to store data and photos for later review and and transfer to hard copy. Additionally the present invention includes a camera 16 facing the entrance that may be utilized when rewound to pinpoint and identify a user in violation of not washing their hands. The camera 16 has a time stamp and also enables a manager/supervisor to remotely view the comings and goings in the restroom from an office.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is new and desired to be protected by Letters Patent is set forth in the appended claims:

1. An apparatus for monitoring the hand washing of an individual in a rest room comprising:

a) means for detecting and differentiating user entry and exit within a restroom;

wherein said entry and exit detection means comprises a sensor in the doorknob of the door which is activated by the movement thereof; said entry and exit detection means comprises: a) a first doorknob sensor disposed within the exterior doorknob wherein said activation indicates user entry; and b) a second doorknob sensor disposed within the interior doorknob wherein said activation indicates a user exit;

b) means for identifying said user;

wherein detection of a user entering and exiting said restroom activates a camera disposed therein to identify said user at the point of entry and are delivered to a memory for storage;

c) means for detecting the flushing of a bathroom fixture selected from a group including commodes, urinals and bidets;

wherein said flush detection means is a commode water sensor that detects the flow of water once flushed wherethen said commode water sensor communicates with said microprocessor and informs it when flushing has occurred and that the user's hands need to be washed;

d) means for detecting the duration of water flow from a sink within a predetermined time span after said bathroom fixture is flushed;

wherein the predetermined required flow duration at said sink is at least sixteen seconds;

e) means for informing said user as to the efficiency of the hand washing as defined by said predetermined time span;

wherein a visual and audible indicator is a visual display and audio speaker that provides an appropriate message according the actions of the user as monitored by said microprocessor;

wherein the user is thanked upon exit by said audible and visual indicators if hand washing occurred for an adequate time span after flushing and f) a microprocessor for monitoring and initiating the functions of the various components.

2. The apparatus for monitoring the hand washing of an individual in a rest room as recited in claim 1, wherein said entry and exit detection means further includes means for communicating with said microprocessor.

3. The apparatus for monitoring the hand washing of an individual in a rest room as recited in claim 1, wherein said user information means is taken from the group of a visual indicator and an audible indicator.

4. The apparatus for monitoring the hand washing of an individual in a rest room as recited in claim 3, wherein said visual indicator is in communication with said microprocessor.

5. The apparatus for monitoring the hand washing of an individual in a rest room as recited in claim 4, wherein said audible indicator is in communication with said microprocessor.

6. The apparatus for monitoring the hand washing of an individual in a rest room as recited in claim 5, wherein said audible indicator is an audio speaker that provides an appropriate message according to the actions of the user as monitored by said microprocessor.

7. The apparatus for monitoring the hand washing of an individual in a rest room as recited in claim 6, wherein the user is warmly greeted upon entry by said audible and visual indicators.

* * * * *